US010781677B2

(12) United States Patent
Mlcak et al.

(10) Patent No.: US 10,781,677 B2
(45) Date of Patent: Sep. 22, 2020

(54) PYROTECHNIC INITIATED HYDROSTATIC/BOOST ASSISTED DOWN-HOLE ACTIVATION DEVICE AND METHOD

(71) Applicant: Halliburton Energy Services, Inc., Houston, TX (US)

(72) Inventors: Matthew Craig Mlcak, Carrollton, TX (US); Bryan William Kasperski, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 65 days.

(21) Appl. No.: 15/571,143

(22) PCT Filed: Jun. 18, 2015

(86) PCT No.: PCT/US2015/036461
§ 371 (c)(1),
(2) Date: Nov. 1, 2017

(87) PCT Pub. No.: WO2016/204768
PCT Pub. Date: Dec. 22, 2016

(65) Prior Publication Data

US 2018/0171764 A1 Jun. 21, 2018

(51) Int. Cl.
*E21B 43/112* (2006.01)
*E21B 43/1185* (2006.01)

(52) U.S. Cl.
CPC ..... *E21B 43/11852* (2013.01); *E21B 43/112* (2013.01); *E21B 43/1185* (2013.01)

(58) Field of Classification Search
CPC ..... E21B 43/11852; E21B 43/11855; E21B 43/112
See application file for complete search history.

(56) References Cited

U.S. PATENT DOCUMENTS 2,457,277 A * 12/1948 Schlumberger ..... E21B 43/112 166/55.1
3,398,803 A 8/1968 Leutwyler et al.
(Continued)

FOREIGN PATENT DOCUMENTS

WO 2014/109748 A1 7/2014
WO 2014/186672 A1 11/2014

OTHER PUBLICATIONS

International Preliminary Report on Patentability issued in related PCT Application No. PCT/US2015/036461, dated Dec. 28, 2017, 12 pages.

(Continued)

*Primary Examiner* — Nicole Coy
*Assistant Examiner* — Dany E Akakpo
(74) *Attorney, Agent, or Firm* — John W. Wustenberg; Baker Botts L.LP.

(57) ABSTRACT

In accordance with embodiments of the present disclosure, systems and methods for safely, and cost-effectively activating a mechanical perforator using a pyrotechnic initiated hydrostatic activating mechanism. The mechanism includes a piston connected to a power rod. The piston is activated by the rupturing of a disc, which separates a first chamber from a second chamber containing the piston. Upon rupturing of the disc, wellbore fluids fill the second chamber forcing the piston to move from a first position to a second position, which causes activation of the mechanical perforator. The first chamber may optionally be filled with a pressurized gas, such as nitrogen or air, to add a boost assist to activation of the piston.

15 Claims, 6 Drawing Sheets

(56) References Cited

U.S. PATENT DOCUMENTS

| | | | | |
|---|---|---|---|---|
| 4,429,741 | A | 2/1984 | Hyland | |
| 5,127,477 | A | 7/1992 | Schultz | |
| 5,447,202 | A | 9/1995 | Littleford | |
| 5,680,905 | A * | 10/1997 | Green | E21B 43/11852 175/4.54 |
| 6,550,551 | B2 | 4/2003 | Brunnert et al. | |
| 7,000,705 | B2 | 2/2006 | Buyers et al. | |
| 7,552,773 | B2 | 6/2009 | Wright et al. | |
| 7,757,767 | B2 | 7/2010 | Hill et al. | |
| 7,793,733 | B2 | 9/2010 | Stewart | |
| 8,235,103 | B2 | 8/2012 | Wright et al. | |
| 8,322,426 | B2 | 12/2012 | Wright et al. | |
| 8,813,848 | B2 | 8/2014 | Frazier | |
| 2010/0200245 | A1 | 8/2010 | Ringgenberg et al. | |
| 2010/0206633 | A1* | 8/2010 | Moore | E21B 43/11852 175/4.56 |
| 2010/0307773 | A1 | 12/2010 | Tinnen et al. | |
| 2011/0088946 | A1 | 4/2011 | Moore et al. | |
| 2011/0265987 | A1* | 11/2011 | Wright | E21B 34/063 166/154 |
| 2012/0024528 | A1 | 2/2012 | Mytopher et al. | |
| 2012/0037360 | A1* | 2/2012 | Arizmendi, Jr. | E21B 23/04 166/250.01 |
| 2012/0298361 | A1* | 11/2012 | Sampson | E21B 23/01 166/297 |
| 2015/0027302 | A1 | 1/2015 | Wall et al. | |

OTHER PUBLICATIONS

International Search Report and Written Opinion issued in related PCT Application No. PCT/US2015/036461 dated Mar. 9, 2016, 15 pages.

Billingham, Matthew et al., "Slickline Signaling a Change", Oilfield Review, vol. 23, Issue 4, Dec. 1, 2011, 10 pages.

* cited by examiner

PYROTECHNIC INITIATED HYDROSTATIC/BOOST ASSISTED DOWN-HOLE ACTIVATION DEVICE AND METHOD

CROSS-REFERENCE TO RELATED APPLICATION

The present application is a U.S. National Stage Application of International Application No. PCT/US2015/036461 filed Jun. 18, 2015, which is incorporated herein by reference in its entirety for all purposes.

TECHNICAL FIELD

The present disclosure relates generally to activation of down-hole devices in subterranean formations, and more particularly, to a pyrotechnic initiated hydrostatic/boost assisted device for activating the down-hole device.

BACKGROUND

Hydrocarbons, such as oil and gas, are commonly obtained from subterranean formations that may be located onshore or offshore. The development of subterranean operations and the processes involved in removing hydrocarbons from a subterranean formation typically include a number of different steps such as, for example, drilling a wellbore at a desired well site, treating the wellbore to optimize production of hydrocarbons, and performing the necessary steps to produce and process the hydrocarbons from the subterranean formation.

There are a number of different methods for perforating a production tubing or casing in connection with a work-over or other post-completion well service operation. Commonly used methods employ explosive charges. There are a number of logistical issues associated with the use of explosives, however, to perforate production tubing or casing. In many instances, transport of the necessary explosives is tightly controlled making movement of the devices to the well site very difficult.

Mechanical perforation avoids the logistical issues of explosives. Devices for mechanically perforating a well casing without the use of explosives are also known in the art and, in fact, predate the use of explosives. Such devices include, for example, laterally movable punches and toothed wheel perforators. Mechanical perforators require sufficient motive force to be activated to operate effectively. Current systems employ large rechargeable hydraulic power sources for actuating the down-hole tools. Such systems typically employ complex valving schemes to operate the tool. An activation system which utilizes a much smaller and less complex device to perforate the tubing or casing and which is thus desired.

BRIEF DESCRIPTION OF THE DRAWINGS

For a more complete understanding of the features and advantages of the present disclosure, reference is now made to the detailed description of the present disclosure along with the accompanying figures in which corresponding numerals in the different figures refer to corresponding parts and in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles disclosed herein, which is not limited to any specific details of these embodiments.

In the following description of the representative embodiments of the present disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Figure 1:
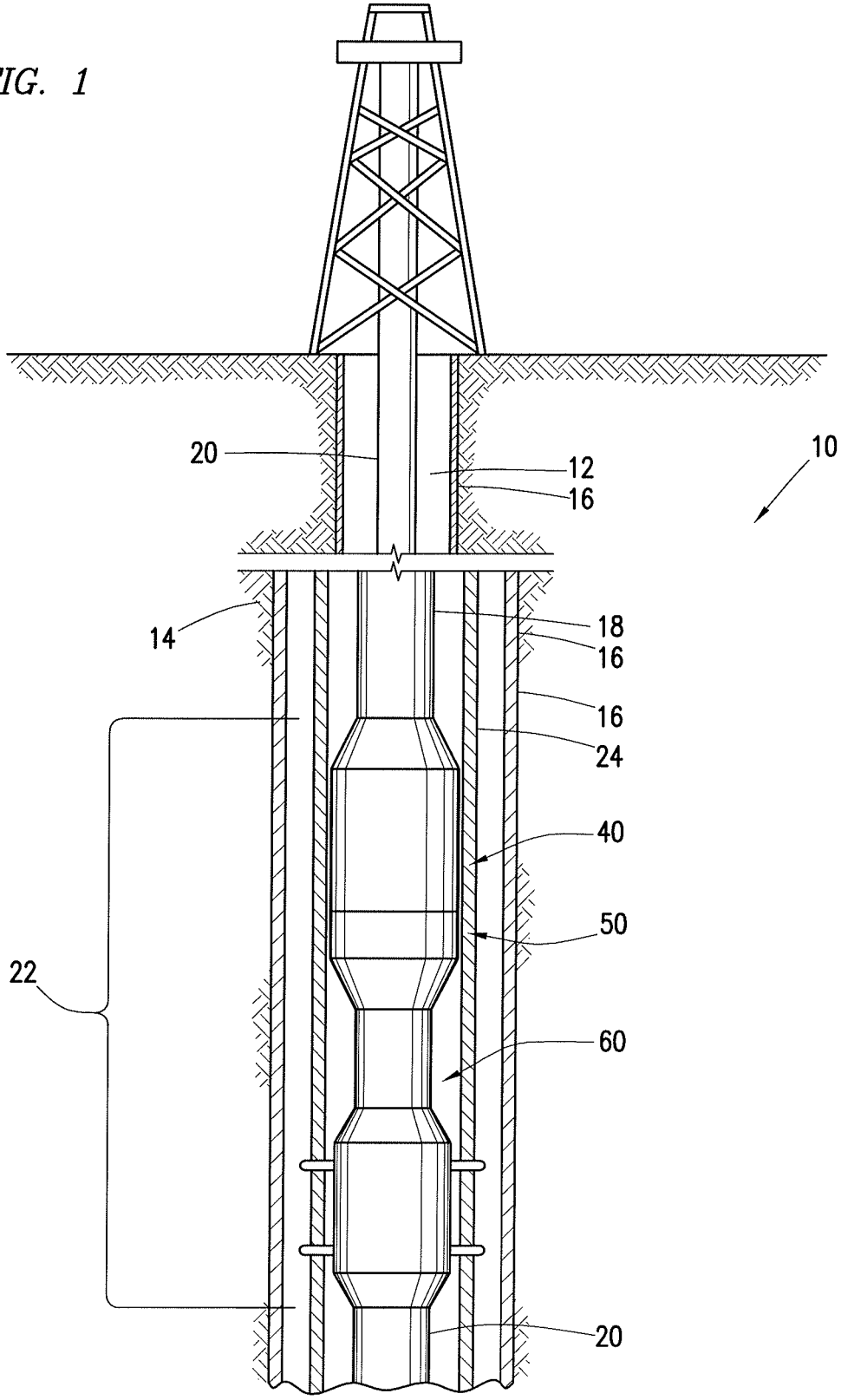
FIG. 1 illustrates a downhole tool employing a mechanical perforator which is activated using a pyrotechnic initiator device in accordance with the present disclosure.

FIG. 1 is a schematic view of a well system including an embodiment of the mechanical perforator activating apparatus according to the present disclosure positioned in a subterranean wellbore. A well system 10 is depicted having a wellbore 12 extending through a subterranean formation 14, shown having casing 16. The devices disclosed herein can be used in cased or uncased wells, vertical, deviated or horizontal wells, and for on-shore or off-shore drilling. A tubing string 18 is shown having a plurality of tubing sections 20 and a down-hole tool 22, which includes mechanical perforator 30, downhole force generator (DFG) assembly 40, and force multiplier assembly 50. The downhole tool 22 is inserted into a section of production tubing or casing 24, which is installed in the well bore 12. A mechanical linkage assembly 60 between the DFG and the downhole tool is provided for transferring the power generated by the DFG into longitudinal or rotary movement, via a shaft, piston, sleeve, etc. The DFG assembly preferably includes a processor to operate the tool, measure environmental and tool parameters, etc. The mechanical perforator 30 operable by DFG units is described generally below with reference to FIGS. 6 and 7, but is not described in any detail as those of ordinary skill in the art will be familiar with such devices. Indeed, the present disclosure is directed to the activating mechanism for the mechanical perforator 30 and not the mechanical perforator itself.

Figure 2:
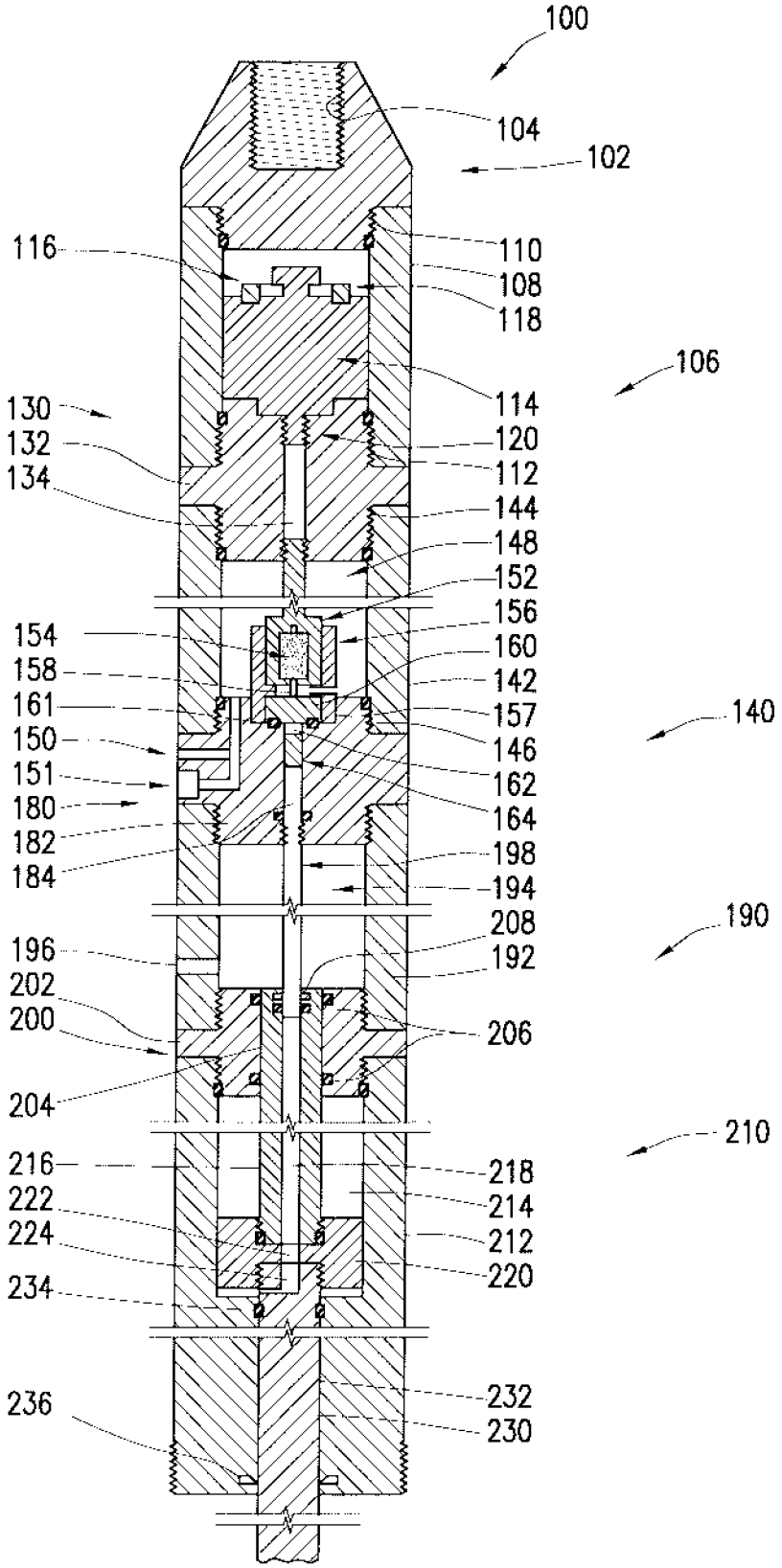
FIG. 2 is a cross-sectional schematic view of an exemplary booster-based, force-balanced activating device according to an aspect of the present disclosure and in an initial position.
Figure 3:
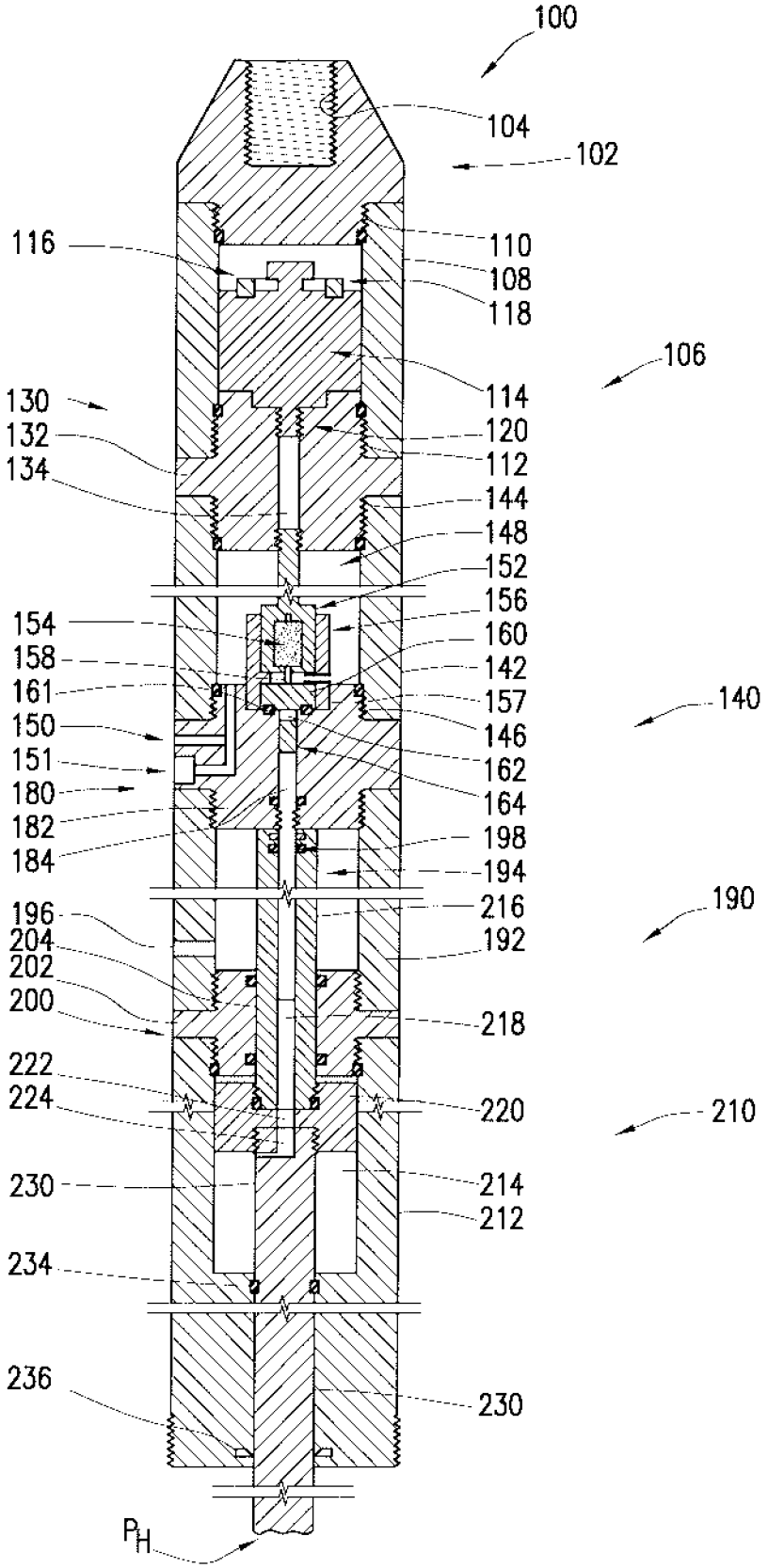
FIG. 3 is a cross-sectional schematic view of an exemplary booster-based, force-balanced activating device according to FIG. 2 in an activated position.

FIG. 2 is a cross-sectional schematic view of an exemplary booster-based, force-balanced down-hole tool activating device 100 according to an aspect of the present disclosure. FIG. 3 is a cross-sectional schematic view of an exemplary booster-based, force-balanced down-hole tool activating device according to FIG. 3 in an activated position. The Figures are discussed in conjunction. The movement most frequently used is a linear axial stroke, in either direction. The embodiment of the down-hole tool activating device shown provides an axially upward movement of a selected stroke length. As those of skill in the art will recognize, other embodiments can provide a downward activation stroke. Additionally, the down-hole tool activating device can be used to provide other types of mechanical motion, such as rotational, etc., with appropriate mechanical parts to translate motion, as will be recognized by those of skill in the art. The embodiment is discussed in terms of a down-hole tool activating device for use in linear actuation of a mechanical perforator, however, it is understood that the devices disclosed herein can be used in other types of tool assemblies and for providing non-axial motive force.

The down-hole tool activating device 100 has an upper connector subassembly 102, shown configured for connection at threads 104 to a sucker rod (not shown) or similar. It is understood that the upper connector can be selected for connection to a tool string, wireline, coiled tubing, slickline, e-line etc. The upper connector 102 has lower threads at 110 which mate with the housing 108 of the control assembly 106.

The control assembly 106 has a housing 108, preferably a tubular body, connected to the upper connector sub 102 at threads 110 and connected at threads 112 to connector subassembly 130. The control assembly 106 houses an electronic control module 114 having, in a preferred embodiment, a power source, such as batteries, an electric-powered timer or timing device, and indicators 118 for start-up and timer set values. The indicators can be LED or other indicators as known in the art. The timer and battery packs are not discussed in detail and are known in the art. An electrical connector 116 is preferably provided for e-line start. It is also possible to provide electrical power via power line from the surface for powering the actuator (pyrotechnic initiator) 154. A hermetic connector 120 is positioned between the control module 114 and connector sub 130 to provide a hermetically sealed section for housing the control module.

A connector subassembly 130 has a connector body 132 with a bore 134 defined therein and extending axially there through. The bore 134 houses communication lines, such as electrical wiring, necessary for transmitting a signal from the control module to the actuator (pyrotechnic initiator) 154. The connector sub attaches to housing 108 at its upper end and to housing 142 at its lower end.

A booster assembly 140 has a housing 142 attached at threads 144 to the connector sub 130 and at threads 146 to connector sub 180. The booster assembly 140 defines a booster chamber 148 which is pre-charged with a pressurized fluid, preferably an inert gas to an actuation pressure. A charge port 151 and charging valve 150 are provided, with appropriate fluid passageways to the chamber, for supplying the pressurized gas to the chamber. In the embodiment shown, the charging valve and port are positioned in connector sub 180, although they can be positioned in connector sub 130 or as part of the booster assembly 140.

Positioned in the booster assembly are a pyrotechnic initiator 154, actuator retainer 152, rupture disc 160, and pin actuator 158. The initiator 154 is electrically connected via wire extending from the actuator retainer 152, through a conduit which is in threaded connection to the passageway 134 of connector assembly 130, and the control electronic control module 114. The initiator is triggered by a small electrical charge. The actuator retainer 152 houses the initiator 154. The rupture disc retainer and actuator guide 156 is mounted to the tool assembly, for example, to the connector assembly 180, as shown, via threaded connection or similar. Alternately, the retainer can be mounted to the housing, etc. The initiator 154 is positioned adjacent or proximate a rupture disc 160 that initially blocks fluid flow from the pressurized chamber.

Small, pyrotechnic initiators 154 are available from commercial vendors known in the art, such as SDI, Inc. The pyrotechnic initiator utilizes a small amount of pyrotechnic material, triggerable by a low electrical charge, to drive a thruster pin 158 longitudinally into and rupturing the rupture disc 160. The thruster pin 158 is preferably hollow with a relief port on the stem such that if the disc fails to rupture after the pin has pushed through the disc, a fluid path is available through the pin. Note that the pyrotechnic initiator does not provide the motive force for movement of the activating rod. The tool assembly is not a pyrotechnic activating tool. The initiator only provides motive force to move the pin actuator to rupture the rupture disc 160. The motive force for activating the tool is provided by the release of pressurized gas in the booster chamber. Because such a low amount of force is required of the initiator, and such a small amount of chemical or pyrotechnic required to provide the force, the preferred pyrotechnic initiator is classified by DOT and BATF as a non-explosive for purposes of transportation and shipping.

In addition to the preferred pyrotechnic initiator, other initiators can be used, preferably low-powered and classified as non-explosive. For example, such initiators include electrical, chemical, thermal, and other initiators. The initiators can open the pressurized chamber by opening, melting, dissolving, burning, etc., a fluid barrier. Further, the initiator can be used to power or actuate a variety of available actuators, such as a thruster pin, a check-valve, other valves, etc., to open the pressurized chamber to fluid flow.

Power to trigger the initiator is provided from the battery pack or power source in the electronic control module 114 of the control assembly 106. Since the preferred initiator is small and requires low power to initiate, it is ideal for low-powered battery activation. With a small power requirement, the battery can be small and low power and included within the timer module. An exemplary battery might include a single low rate "AA" primary lithium cell. The timer module can be small and used for the various tools for the different activating tools. The small timer module can thermally insulated, for example, for use in higher temperature operations within the larger housings of the bigger activating tools. The timer module is preferably switch-selectable and can include an electrical start port for either e-line or a pressure/temperature switch. Additional features could be added to the timer (pressure, temperature, motion, etc.); however, this would result in a larger electronics and battery assembly.

The rupture disc 160 can be selected from those known in the art and alternative discs and rupture assemblies will be apparent to those of skill in the art. The disc can be made of ceramic, metal, plastic, or other similar material. The disc can be ruptured, punctured, dissolved, melted, or otherwise penetrated, depending on the selected initiator and actuator. The preferred assembly utilizes a rupture disc which is physically punctured or broken by the extendable pin of the initiator. The rupture disc 160 initially blocks fluid flow from pressurized chamber 148 into passageway 184 of connector assembly 180. In a preferred embodiment, the rupture disc is mounted to the housing, connector assembly or retainer 156. The disc assembly is positioned in a bore 157 designed for that purpose in the connector assembly 180. Seals 161 are provided as necessary to facilitate assembly and fluid isolation. The retainer 156 provides and maintains positioning of the disc. Upon rupture, fluid communication is provided between the pressurized chamber 148 and the passageway 184 through connector assembly 180.

The initiator assembly may be a thruster assembly for rupturing discs, such as the actuator assemblies commercially made available by the assignee herein, Halliburton Energy Services, Inc. Additional actuator assemblies are known in the art and will be understood by persons of skill in the art. Key components are the rupture disc, an electrical power source, and an electrically-initiated method of breaching the barrier disc. In one exemplary embodiment, the electrical power source is a battery, and a thruster assembly is used to puncture the disc.

Connector assembly 180 is attached to a vent chamber assembly 190, preferably by threaded connection to a vent chamber housing 192. The vent chamber 194 defined within the vent chamber assembly contains fluid at hydrostatic pressure as it is open to fluid flow between the chamber and the exterior of the tool (the wellbore). One or more ports 196 provide fluid communication between chamber and exterior. A thick-walled tube 198 extends from the passageway 184 to a force-balance piston rod 216, providing communication of the released pressurized gas from the pressurized chamber 148 to the piston passageway 218. As piston rod 216 moves upward into the vent chamber, pressure is equalized in the vent chamber 194 as fluid flows out of the chamber through ports 196. Note that the activation section is force balanced by hydrostatic pressure acting on the power rod 230 from below, so the activation action is independent of hydrostatic pressure.

A flow restrictor 164 is preferably positioned across an upper portion 162 of the passageway 184 in body 182 of the connector assembly 180. The speed of activation is controlled by the flow restrictor. The flow restrictor can be positioned elsewhere along the flow path from the pressurized chamber to the piston head. Flow restrictors and use thereof to control activation speed is known in the art. The flow restrictor can be a flow nozzle, orifice, plate, inflow control device, autonomous inflow control device, tortuous path, as known in the art.

A connector assembly 200 provides flow connection between the vent chamber assembly 190 and the force-balance piston assembly 210. The connector assembly body 202 is threadedly attached to the vent chamber housing 192 and to a piston housing 212. An axial passageway 204 is defined through the connector body, the piston rod 216 axially slidable therein. Seals 206 are provided for sealing engagement between passageway wall and piston. Further, rod-wipes 208, or similar, are mounted to wipe the exterior surface of the piston as it moves through the passageway 204.

A piston assembly 210 is attached to the connector assembly 200 at housing 212. The housing defines a piston chamber 214 which is divided into two spaces by piston head 220. The chamber 214 is preferably at atmospheric pressure initially. Piston rod 216 defines an axial passageway 218 therein providing fluid communication from the tube 198 to a passageway 222 through the piston head 220. The piston rod 216 is mounted to the piston head 220. A power rod 230 is attached to the lower end of the piston head 220. Port 224 provides fluid communication from the passageway 218 of the piston rod to the chamber 214 below the piston head 220. When pressurized gas is released from pressurized chamber 148, the gas flows through the various passageways and tubes, through passageway 218 of the piston rod, through passageway 222 of the piston head 220, and through port 224 to the chamber 214 below the piston head. The pressurized gas forces the piston head upward. Upward movement of the piston head causes piston rod 216 to slide upwardly through the connector assembly 200 and into vent chamber 194. Movement of the piston head also pulls power rod 230 upwardly through a bore 232 defined in the lower end of the piston housing sub 210. Appropriate seals 234 and wipers 236 may be employed.

Movement of the power rod, axially, provides the necessary motion to activate the mechanical perforator positioned below the activation device. The activation force is supplied by the pre-charged fluid in the booster chamber. Carrying the activation force with a gas pre-charge means a large motor and battery arrangement, typical in many downhole force generators, is not required.

The entire assembly is compact, reducing the overall length of the tool assembly. This can be important in negotiating long, deviated or horizontal wellbores. Preferably, the length of the activation tool assembly is on the order of six feet for every eight inches of stroke. Greater activation force can be provided by utilizing a force-multiplying piston having varying surface areas on either side of the piston head, as is known in the art.

Figure 4:
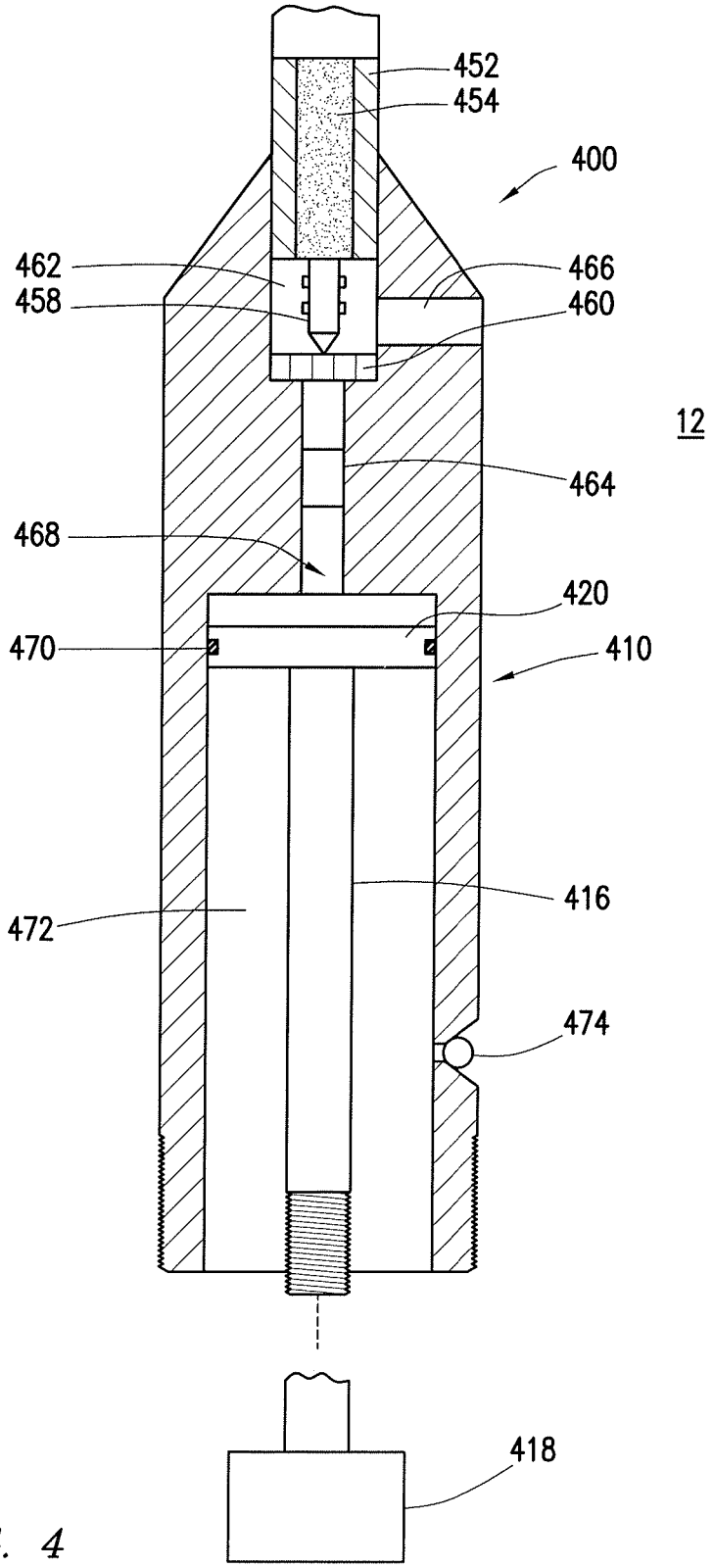
FIG. 4 is a cross-sectional schematic view of an exemplary hydrostatic-based, force-balanced activating device according to another aspect of the present disclosure.

FIG. 4 illustrates a hydrostatically-based, force-balanced down-hole tool activating device 400 according to another embodiment of the present disclosure. The down-hole tool activating device 400 may have many of the same components of the device illustrated in FIGS. 2 and 3. The main difference between the embodiment in FIGS. 2 and 3 and that of FIG. 4 is that rather than having a pressurized booster chamber which fills the chamber containing the piston assembly 210, the chamber containing the piston assembly is filled with wellbore fluid at wellbore pressure. FIG. 4 shows the piston assembly 410 as a simple piston having a head 420 and power rod 416. The piston assembly 410 however may alternatively have the same construction as piston assembly 210. The main feature of this embodiment is that is uses the wellbore fluid to act on the piston assembly, which in turn via the power rod 416 activates the mechanical perforator or other down-hole device 418.

The down-hole tool activating device 400 of the embodiment of FIG. 4 also utilizes a pyrotechnic initiator 454, actuator retainer 452, rupture disc 460, and pin actuator 458, all of which operate in the manner described above. Upon activation of the pyrotechnic initiator 454 and puncturing of the rupture disc 460, wellbore fluid from the wellbore 12 enters upper chamber 462 containing the pin actuator 458 via port 466. The wellbore fluid may optionally flow through a flow restrictor 464 as it enters intermediate chamber 468, which may optionally be at atmospheric pressure. One or more seals 470 hermetically seal intermediate chamber 468 from lower chamber 472, which may also optionally be at atmospheric pressure. A one-way relief valve 474 may optionally be disposed in the housing of the assembly 400 to relieve pressure from the lower chamber 472 as the piston assembly 410 is driven downward by the pressure of the wellbore fluid entering intermediate chamber 468 and acting on piston head 420. As those of ordinary skill in the art will appreciate, the hydrostatically-based and boost-assisted forces on the piston assemblies 210, 410 may be combined to enhance the overall actuation force on those assemblies.

Figure 5:
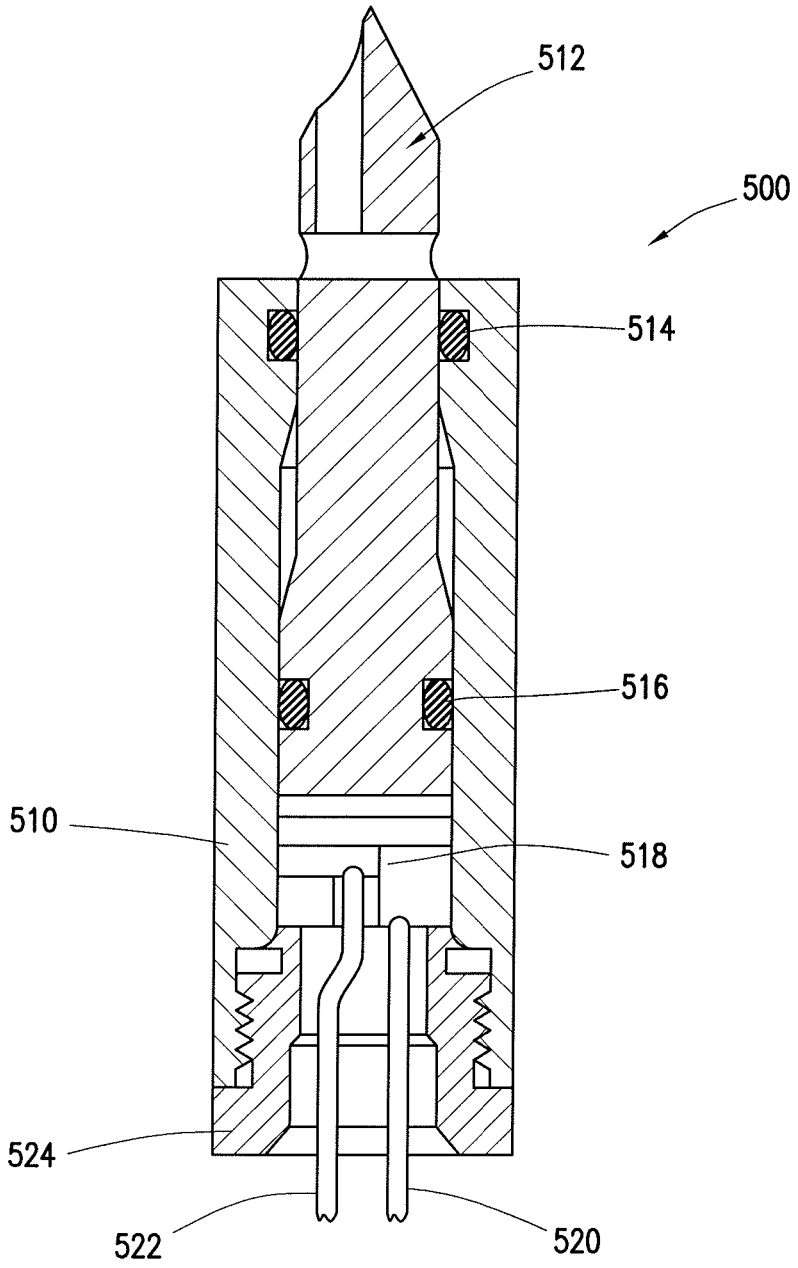
FIG. 5 is a cross-sectional schematic view of a pyrotechnic initiator in accordance with the present disclosure.

The details of the pyrotechnic initiators shown in FIGS. 2-4 are shown in FIG. 5. The assembly is referred to generally by reference numeral 500. The pyrotechnic initiator 500 is defined by a housing 510 which contains a pin actuator or piston pin 512. The piston pin 512 is sealed to an interior surface of the housing 510 by a pair of O-ring seals 514, 516. The piston pin 512 has a base disposed within the housing and a tip disposed outside the housing. The pyrotechnic initiator 500 further includes a pressure cartridge igniter 518, which is disposed adjacent to, and below, the piston pin 512 and upon activation acts upon the piston pin. One of the O-rings is disposed adjacent the tip of the piston pin 512 and the other O-ring is disposed adjacent the pressure cartridge igniter 518. A pair of connector pins 520, 522 connects the pressure cartridge igniter 518 to the battery pack or power source in the electronic control module 114 of the control assembly 116, shown in FIGS. 2-3. The pyrotechnic initiator 500 further includes an end cap 524 which enables the initiator to connect to the actuator retainer 152 or other similar housing member.

Figure 6:
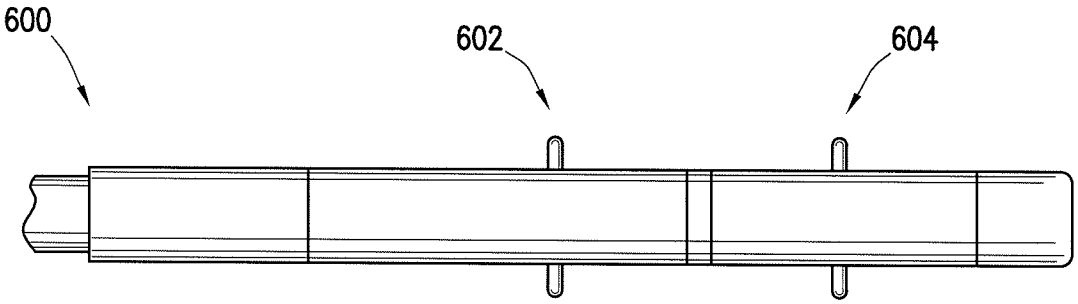
FIG. 6 is a schematic view of down-hole tool with a button type mechanical perforator shown in the activated position.
Figure 7:
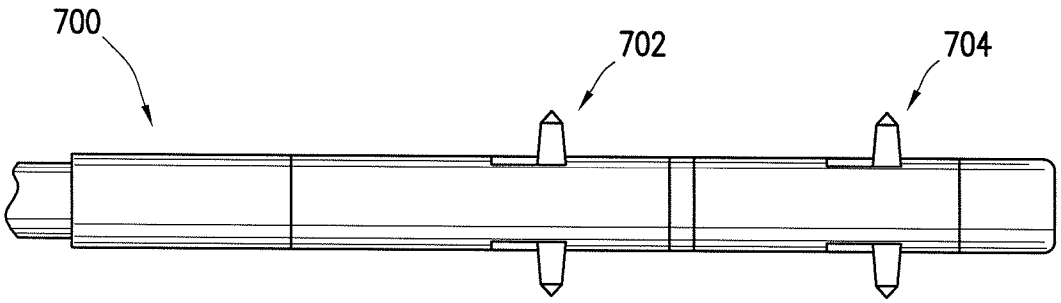
FIG. 7 is a schematic view of down-hole tool with a blade type mechanical perforator shown in the activated position.

FIGS. 6 and 7 show two exemplary mechanical perforators which may be connected to and activated by the down-hole tool activating devices described herein. In the embodiment illustrated in FIG. 6, the mechanical perforator 600 is defined by two pairs of plugs or inserts 602, 604, which are shown in the activated position. The plugs or inserts 602, 604 perforate the production tubing 24 upon activation. The plugs or inserts are connected to a series of mechanical linkages which are activated by the piston assemblies described above upon firing of the pyrotechnic initiator described herein. In the embodiment illustrated in FIG. 7, the down-hole tool 700 is defined by two pairs of blade-type mechanical perforators 702, 704, which are also connected to via various linkages to the piston assemblies described above upon firing of the pyrotechnic initiator. As explained above, while the present disclosure describes two different types of mechanical perforators, the present disclosure is not directed to the mechanical perforators themselves, but rather that down-hole tool activating device which activates these perforators. As those of ordinary skill in the art will appreciate, the down-hole tool activating device disclosed herein can be used to activate any type of mechanical perforator.

A person skilled in the art would, upon a careful consideration of the above description of representative embodiments, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present disclosure being limited solely by the appended claims and their equivalents.

What is claimed is:

1. A down-hole tool, comprising:

(a) a housing having an upper chamber, an intermediate chamber, and a lower chamber, wherein a pressurized gas is disposed within the upper chamber, wherein a passageway couples the upper chamber to the lower chamber;

(b) a pyrotechnic initiator disposed within the upper chamber, comprising:

a housing defining the pyrotechnic initiator;

a piston pin having a base disposed within the housing defining the pyrotechnic initiator and a tip disposed outside the housing;

a pressure cartridge igniter disposed adjacent to the piston pin;

a pair of connector pins connected to the pressure cartridge igniter; and a pair of O-rings which hermetically seals the piston pin to an inside surface of the housing defining the pyrotechnic initiator wherein one of the O-rings is disposed adjacent the tip and the other O-ring is disposed adjacent the pressure cartridge igniter;

(c) a rupture disc disposed within the upper chamber at an interface between the upper chamber and the intermediate chamber, wherein the rupture disc inhibits fluid communication between the upper chamber and the lower chamber through the passageway;

(d) a piston disposed in the lower chamber.

2. The down-hole tool according to claim 1, further comprising a port disposed within the housing of the down-hole tool.

3. The down-hole tool according to claim 1, further comprising a flow restrictor disposed within the intermediate chamber.

4. The down-hole tool according to claim 1, further comprising a charge port formed in the housing of the down-hole tool to enable pressurized gas to be supplied to the upper chamber.

5. The down-hole tool according to claim 1, further comprising a one-way relief valve formed in the housing of the down-hole tool adjacent to the lower chamber.

6. The down-hole tool according to claim 1, wherein the piston pin is disposed adjacent to the rupture disc.

7. The down-hole tool according to claim 1, further comprising a power source connected to the pair of connector pins.

8. The down-hole tool according to claim 7, wherein the power source comprises a battery connected to a timer module and selector switch, the timer module capable of activating the selector switch to connect the power source to the pressure cartridge igniter.

9. The down-hole tool according to claim 1, wherein a region of the upper chamber on a first side of the pyrotechnic initiator is at atmospheric pressure and the intermediate chamber is at atmospheric pressure.

10. The down-hole tool according to claim 9, wherein upon insertion into a wellbore, down-hole fluids in the wellbore enter the intermediate chamber.

11. The down-hole tool according to claim 1, further comprising a power rod connected to the piston, which upon activation activates a mechanical perforator coupled to the down-hole tool.

12. A method for activating a mechanical perforator inserted into a wellbore, comprising:

(a) activating a pyrotechnic initiator disposed within a down-hole tool, wherein the down-hole tool is coupled to the mechanical perforator;

(b) rupturing a disc disposed at an interface of a first chamber in communication with wellbore fluids and a second chamber which is at atmospheric pressure, wherein the disc is ruptured by a piston pin puncturing the disc, the piston pin being disposed in the first chamber and moving in response to activation of the pyrotechnic initiator;

(c) moving a piston disposed in the second chamber in response to hydraulic pressure exerted by the wellbore fluids entering the second chamber; and (d) activating the mechanical perforator in response to movement of the piston.

13. The method according to claim 12, wherein activating the mechanical perforator moves a plug, insert or blade which in turn perforates a section of production casing.

14. The method according to claim 12, wherein the piston forms a fluid-tight seal within the second chamber and wherein pressure is relieved in the second chamber upon movement of the piston via a one-way relief valve.

15. The method according to claim 12, wherein the pyrotechnic initiator is activated by a timer module and selector switch connecting a battery to a pressure cartridge igniter upon reaching a certain condition.

* * * * *